US006761609B1

(12) United States Patent
Andersen

(10) Patent No.: US 6,761,609 B1
(45) Date of Patent: Jul. 13, 2004

(54) TOY BUILDING SET WITH FLEXIBLE TOY BUILDING SHEET ELEMENT

(75) Inventor: Dorthe Kjærulff Andersen, Vejle Ø (DK)

(73) Assignee: Interlego AG, Baar (CH)

( * ) Notice: Subject to any disclaimer, the term of this patent is extended or adjusted under 35 U.S.C. 154(b) by 0 days.

(21) Appl. No.: 10/070,716

(22) PCT Filed: Sep. 5, 2000

(86) PCT No.: PCT/DK00/00487

§ 371 (c)(1),
(2), (4) Date: Jun. 6, 2002

(87) PCT Pub. No.: WO01/17633

PCT Pub. Date: Mar. 27, 1986

(30) Foreign Application Priority Data

Sep. 6, 1999 (DK) ..... 1999 01249

(51) Int. Cl.[7] ..... A63H 33/06
(52) U.S. Cl. ..... 446/120; 446/487; 446/124
(58) Field of Search ..... 446/105, 107–109, 446/119, 117, 118, 120, 124, 122, 385, 388, 487, 121

(56) References Cited

U.S. PATENT DOCUMENTS

| | | | | |
|---|---|---|---|---|
| 1,273,605 A | * | 7/1918 | Goldman | 446/83 |
| 2,023,300 A | * | 12/1935 | Barnett | 446/86 |
| 2,031,848 A | | 2/1936 | Ogden | |
| 2,522,149 A | * | 9/1950 | Tunstall | |
| 2,883,764 A | * | 4/1959 | Stephens | 446/118 |
| 3,078,616 A | * | 2/1963 | Smith | 446/86 |
| 3,594,940 A | * | 7/1971 | Yonezawa | 446/118 |
| 5,562,519 A | * | 10/1996 | Loewenton | 446/126 |
| 5,833,512 A | * | 11/1998 | Nicola | 446/114 |

FOREIGN PATENT DOCUMENTS

| | | | |
|---|---|---|---|
| DE | 1938565 | | 2/1970 |
| DE | 2707056 | | 8/1977 |
| DE | 19642507 | | 4/1998 |
| GB | 593321 A | * | 10/1947 |
| GB | 633055 A | * | 12/1949 |
| GB | WO 86/01738 | * | 3/1986 |
| WO | WO 86/01738 | | 3/1986 |

* cited by examiner

*Primary Examiner*—Jacob K. Ackun
*Assistant Examiner*—Bena B. Miller
(74) *Attorney, Agent, or Firm*—Pitney Hardin LLP

(57) ABSTRACT

A toy building set comprising a plurality of toy building elements (1, 3) provided with complementary coupling means. At least one of the toy building elements (3) is/are provided with at least one groove (4) provided in an outwardly facing face of the toy building element (3), said groove (4) being able to receive and frictionally secure the edge of a toy building sheet element (5, 5*a*). The toy building sheet element (5, 5*a*) is planar with an even thickness that slightly exceeds the narrowest width of the groove (4) in the second toy building element (3), and it is made of a self-supporting, soft, elastically deformable, and form-stable material.

6 Claims, 1 Drawing Sheet

TOY BUILDING SET WITH FLEXIBLE TOY BUILDING SHEET ELEMENT

Figure 1:
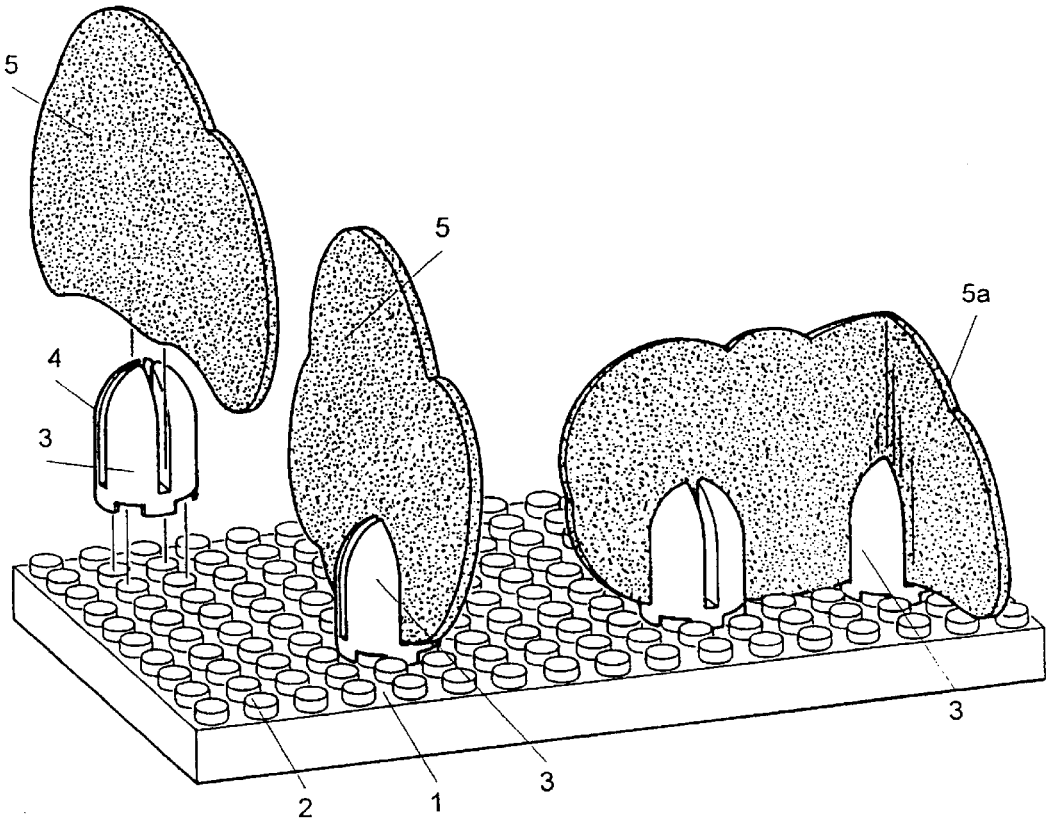

The invention relates to a toy building set as featured in the introductory part of claim 1.

Today, many varieties of toy building sets are known that have the distinguishing feature of containing a number of different toy building elements whereby it is possible to build various structures by interconnection of different toy building elements. Most prior art toy building sets comprise a number of building elements made of a relatively hard plastics material. Typically, the building elements are provided with coupling means, e.g. studs, on their top face and with coupling means on their bottom face that are complementary to the coupling means arranged on the top face.

There are plastics toy building sets wherein some elements have "organic" shapes, ie elements that deviate from a purely box-like shape. Such elements, however, are also made of a hard plastics material, and therefore they do not exhibit any flexibility.

Toy building sets are also known that comprise metal elements in the form of bars and sheets provided with holes, which elements can be assembled by means of bolts and nuts. In this toy building set there are also thin plastics sheets that are also provided with holes and which can therefore be joined with the metal elements by screwing. Depending on the mounting of the plastics sheets, they can be caused to assume organic shapes to allow structures of various appearances. It is a drawback of this building set that the plastics sheets are to be mounted by means of bolts and nuts which makes mounting very cumbersome.

Finally, a building system is known from DE 196 42 507 C1 that comprises building elements provided with grooves, and other building elements in the form of assembly lists that can be mounted and secured in the grooves. The assembly lists are made of a rigid material and have corrugated edges that impart a securing flexing effect thereto when said edges are mounted in the grooves. The assembly lists being made of a rigid material, they are unable to assume organic shapes.

Thus, there is a need for a toy building set comprising sheet elements that can be caused to assume various organic shapes and that can be mounted directly on toy building elements without use of particular assembly means.

This is obtained by configuring the toy building set described above with the features given in the characterising part of claim 1.

Hereby a toy building set is obtained whereby it is possible to construct organic structures, wherein the toy building sheet elements can be caused to assume an unlimited number of organic shapes depending on the way in which they are mounted in a toy building element featuring a groove or between a plurality of such toy building elements.

The thickness of the toy building sheet element slightly exceeding the width of the groove, and it being made of a soft material, the edge of the toy building sheet element can be pressed into the groove and frictionally secured therein, since the material presses on the inside of the groove.

If the toy building sheet element is arranged between two toy building elements provided with grooves, it can be caused to assume any organic shape between these toy building elements. When the toy building sheet elements are once again removed from the other toy building elements, it will resume its original planar configuration because it is made of an elastically deformable and formstable material.

Preferably the toy building sheet element is made of a foamed plastics material, e.g. polystyrene, which imparts a relatively high moment of inertia to the toy building element relative to its weight. This means that a relatively high degree of rigidity will be imparted to the toy building sheet element while, simultaneously, its softness is maintained.

In order to make the toy building sheet element more interesting, it may be configured with an organically shaped outer contour. Simultaneously the toy building element featuring a groove can be configured as an upwardly domed cylinder provided with two vertical grooves in two diametrical planes. If a toy building sheet element with an organically configured outer contour is arranged in such toy building element featuring grooves it is possible to imitate e.g. trees and bushes.

Preferably the grooves have decreasing width from the outer edge of the toy building element and inwards which allows the toy building sheet element to wedge itself securely in the groove.

According to a particularly preferred embodiment the coupling means of the toy building elements comprise cylindrical coupling studs and coupling means that are complementary therewith.

Figure 2:
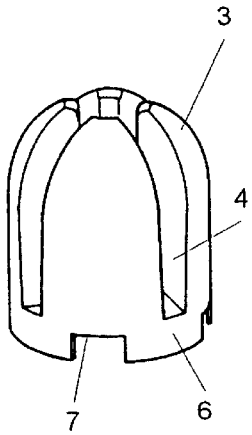
Figure 3:
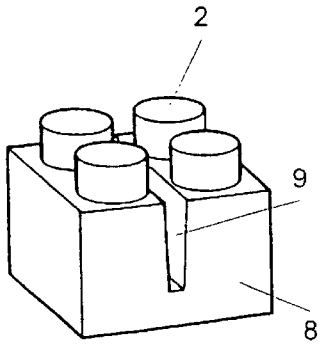

The invention will now be described in closer detail with reference to the drawings, wherein FIG. 1 shows a landscape construction wherein a toy building set according to the invention has been used;

FIG. 2 shows a preferred embodiment of a toy building element provided with grooves for receiving a toy building sheet element; and FIG. 3 shows a toy building element known per se and provided with a groove for receiving a toy building sheet element.

FIG. 1 shows a landscape that has been constructed by means of toy building elements in a toy building set according to the invention. The toy building set comprises a building plate 1 provided with coupling studs 2. Preferably the entire building plate 1 is provided with coupling studs 2, but for the sake of clarity only some of these are shown. Moreover, the toy building set comprises toy building elements 3 that are provided with grooves 4 for receiving the edge of toy building sheet elements 5,5*a*. On their bottom face, the toy building elements 3 are provided with coupling means that are complementary with the coupling studs 2 on the building plate 1.

The building plate 1 and the toy building elements 3 are preferably made of a relatively hard plastics material, as it is generally known in case of toy building sets. In a preferred embodiment, the toy building sheet elements 5,5*a* are made of a foamed plastics material, e.g. polystyrene, in order to obtain a sheet which is soft and pliable. Owing to the cell structure the sheet has a relatively high moment of inertia compared to its weight and therefor it appears to be relatively rigid when it is to support its own weight only. However, the material is so pliable that the toy building sheet elements 5,5*a* can readily be deformed elastically to a desired form, as it is the case e.g. with the toy building sheet element 5*a* shown in FIG. 1.

During construction of the landscape shown in FIG. 1, the toy building elements 3 are arranged on the building plate 1 on the desired locations. Then the toy building sheet elements 5,5*a* are mounted in the grooves in the toy building elements 3 where they are secured frictionally. In the embodiment shown, the toy building sheet elements 5 imitate trees or bushes while the toy building element 5*a* imitates a hedge. In the embodiment shown the toy building sheet elements 5,5*a* are green, optionally with patterns painted thereon (not shown).

FIG. 2 shows the toy building element 3 in an enlarged scale. The toy building element 3 is configured as an upwardly domed cylinder, and it is provided with two vertical grooves 4 that are situated perpendicular to each other in each their diametrical plane. On its bottom face (not shown) the toy building element 3 is provided with coupling means that are complementary with the coupling studs 2 on the building plate 1 shown in FIG. 1.

The grooves 4 extend from the top of the toy building element 3 and almost to the bottom 6; however, the bottom 6 being high enough to allow for the presence of the complementary coupling means. Some of these coupling means are constituted by cut-outs 7 that are configured for seizing across the coupling studs 2 on the building plate 1.

The grooves 4 are slightly conical, their width being widest at the top of the toy building element 3 and gradually decreasing towards the bottom. At the top of the toy building element 3, the width of the grooves 4 exceeds the thickness of the toy building sheet elements 5,5*a* which allows for easy introduction of their edges into the grooves 4. At the bottom 6 of the toy building element 3, the width of the grooves 4 is narrower than the thickness of the toy building sheet elements 5,5*a,* which permits securing thereof by friction. The toy building sheet elements 5,5*a* being made of a soft material allows them to adapt readily to the narrow grooves 4.

Mounting of toy building sheet elements 5,5*a* can be accomplished by their edges extending through a groove 4 which is situated in the diametrical plane as shown in connection with the toy building sheet elements 5 in FIG. 1. Alternatively, the toy building sheet elements 5,5*a* can be mounted as shown in connection with the toy building sheet element 5*a* shown in FIG. 1, where it bends, as will appear to the right in the drawing, due to its being pressed down into both grooves 4 of a toy building element 3.

FIG. 3 shows an alternative embodiment of a toy building element provided with a groove for receiving an edge of a toy building sheet element 5,5*a*. The toy building element 8 shown in FIG. 3 corresponds to commonly known box-shaped toy building elements with coupling studs 2 on the top face and coupling means at the bottom (not shown) that are complementary therewith. Additionally, the toy building element 8 is provided with a groove 9 for receiving an edge of a toy building sheet element 5,5*a*.

Advantageously, the groove 9 can also be slightly wedge-shaped like the grooves 4 in the toy building element 3 to facilitate mounting of the toy building sheet elements 5,5*a* and to improve the securing by friction. In the examples shown, the toy building sheet elements 5 are shown with organically configured outer contours. However, they could also be configured with regularly shaped contours, e.g. in the form of rectangles, polygons, circles, etc, without hereby departing from the idea of the invention.

What is claimed is:

1. A toy building set comprising a plurality of toy building elements (1, 3, 8) provided with complementary coupling means and at least one toy building sheet element (5,5*a*) at least one of said toy building elements (3; 8) having at least one groove (4: 9) provided in an outwardly facing face of the toy building element (3; 8), said groove (4; 9) being able to receive and frictionally secure an edge of the toy building sheet element (5, 5*a*), wherein the toy building sheet element. (5, 5*a*) is planar with an even thickness that slightly exceeds the smallest width of the groove (4; 9) of said at least one toy building element (3; 8), and wherein said toy building sheet element is manufactured from a self-supporting, soft, elastically pliable, and form-stable material.

2. A toy building set according to claim 1, wherein the toy building sheet element (5, 51) is comprised of a foamed plastics material.

3. A toy building set according to claim 1, wherein the toy building sheet element (5, 5*a*) has an organically configured outer contour.

4. A toy building set according to claim 1, wherein said at least one of said toy building elements (3) having at least one groove (4) is configured as an upwardly domed cylinder and said at least one groove comprises two vertical grooves (4) in two diametrical planes.

5. A toy building set according to claim 4, wherein said two vertical grooves (4) have a decreasing width from the top of the toy building element and downwards.

6. A toy building set according to claim 1, wherein said complementary coupling means comprise cylindrical coupling studs (2) and a structure complementary thereto.

* * * * *